US009995522B2

(12) United States Patent
Choo

(10) Patent No.: US 9,995,522 B2
(45) **Date of Patent: *Jun. 12, 2018**

(54) ICE BIN AND METHOD OF CRUSHING ICE USING THE SAME

(71) Applicant: Dongbu Daewoo Electronics Corporation, Seoul (KR)

(72) Inventor: Gwang Ho Choo, Gwanju (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 673 days.

This patent is subject to a terminal disclaimer.

(21) Appl. No.: 14/140,252

(22) Filed: Dec. 24, 2013

(65) Prior Publication Data

US 2015/0135739 A1 May 21, 2015

(30) Foreign Application Priority Data

Nov. 21, 2013 (KR) ..... 10-2013-0141915

(51) Int. Cl.

| | |
|---|---|
| ***F25C 1/00*** | (2006.01) |
| ***F25C 5/02*** | (2006.01) |
| ***F25C 5/18*** | (2018.01) |
| *F25C 5/04* | (2006.01) |

(52) U.S. Cl.

CPC ..... *F25C 5/02* (2013.01); *F25C 5/182* (2013.01); *F25C 5/046* (2013.01); *F25C 5/24* (2018.01)

(58) Field of Classification Search

CPC .. F25C 5/02; F25C 5/046; F25C 5/182; F25C 5/007; F25C 5/005; F25C 5/18; F25C 2400/10; F25C 2700/10

USPC ..... 62/66, 320, 344

See application file for complete search history.

(56) References Cited

U.S. PATENT DOCUMENTS 4,972,999 A * 11/1990 Grace ..... F25C 5/046 241/101.1

FOREIGN PATENT DOCUMENTS

| | | |
|---|---|---|
| CN | 101300456 B | 9/2012 |
| KR | 10-2009-0013540 | 2/2009 |

OTHER PUBLICATIONS

Korean Patent Abstracts, Publication No. 10-2009-0013540, Published Feb. 5, 2009, KIPO, Republic of Korea.

* cited by examiner

*Primary Examiner* — Frantz Jules
*Assistant Examiner* — Steve Tanenbaum

(57) ABSTRACT

An ice bin and a method of crushing ice using the same, in which the ice bin includes a case having an upper portion configured to store ice produced by an ice maker, and a dispensing port at one side of a lower end or surface of the case configured to dispense the ice; a transferring unit that transfers the ice from a lower portion of the case to the upper portion of the case; and a crushing unit configured to crush the ice transferred by the transferring unit and discharge the ice to the dispensing port, wherein the crushing unit selectively discharges the ice as ice cubes or as crushed ice.

14 Claims, 12 Drawing Sheets

ICE BIN AND METHOD OF CRUSHING ICE USING THE SAME

CROSS-REFERENCE TO RELATED APPLICATIONS

This application is based on and claims priority from Korean Patent Application No. 10-2013-0141915, filed on Nov. 21, 2013, the disclosure of which is incorporated herein in its entirety by reference.

TECHNICAL FIELD

The present disclosure relates to an ice bin and a method of crushing ice using the same, and more particularly, to an ice bin at a door side of the refrigerator to efficiently utilize an inner space of the refrigerator, and a method of crushing ice using the same.

BACKGROUND

The refrigerator refers to an apparatus that is used for the purpose of storing and maintaining freshness of food for a long period of time. The refrigerator has a food storage chamber, configured to maintain a low temperature by a refrigeration cycle for maintaining freshness of food.

In consideration of the different types, characteristics, storage periods, and the like of food, a plurality of storage chambers in a refrigerator may have different characteristics, so that a user may select a suitable storage method for the food. The representative storage chambers include a refrigerator chamber and a freezer.

The refrigerator chamber maintains a temperature of approximately 3° C. to 4° C. to store freshness of food and vegetables for a long period of time, and the freezer stores frozen food in a frozen state for a long period of time, and maintains a below-zero temperature to maintain the quality of frozen food, and to make and store ice.

In recent years, the refrigerator has been developed to perform various functions in addition to the aforementioned traditional functions of the refrigerator. For example, in the related art, to enjoy cool water from the refrigerator chamber, a user needs to open the door and take out a water bottle stored in the refrigerator chamber. However, in recent years, a refrigerator has been developed to include a dispenser outside the door, supplied with water cooled by cold air in the refrigerator chamber so that the user may obtain cool water without opening the door. Refrigerator having a dispenser with an additional function of purifying water have also been developed.

When a user intends to drink a beverage or water with ice, the user may need to open a freezer door and remove the ice stored in an ice tray in the freezer.

However, it is inconvenient in that the user needs to open the door, take out the ice tray, and thereafter, separate the ice from the ice tray. When the door of the freezer is opened, cold air in the freezer escapes to the outside, which increases in temperature in the freezer. Accordingly, because the compressor performs additional work, energy may be wasted.

Therefore, in recent years, an ice maker is suggested to supply the ice produced from the freezer to an outside of the refrigerator without opening the door.

As illustrated in FIG. 1, the freezer F includes an ice maker 1 at an inner upper portion of the freezer F, configured to make ice using cold air in the freezer F, an ice bin 2 in the freezer F, separated from the ice maker 1 and configured to store ice made by the ice maker, a dispenser 4 on the freezer door 3, configured to dispense the ice to the outside without opening and/or closing the freezer door 3, and an ice chute 5 configured to guide the ice in the ice bin 2 to the dispenser 4.

However, a capacity of the freezer F decreases due to the volume of the ice maker 1. Since the ice maker 1 has a heavy weight (e.g., including the weight of a motor that drives the ice maker and the ice bin), it is inconvenient to disassemble and/or transfer the ice bin for other use and/or cleaning.

A conventional refrigerator/freezer unit may be disclosed in Korean Patent Application Laid-Open No. 10-2009-0013540 (Feb. 5, 2008).

SUMMARY

The present disclosure has been made in an effort to provide an ice bin in which a compact ice maker is on a refrigerator door, and the ice bin may be detachable from the door, and a method of crushing ice using the same.

A technical object to be achieved in the present disclosure is not limited to the aforementioned technical objects, and other unmentioned technical objects may be understood from the description below by those skilled in the technical field to which the present disclosure pertains.

Embodiments of the present disclosure provide an ice bin including a case having an upper portion to accommodate ice produced in an ice maker, and a dispensing port at one side of a lower end surface of the case, configured to dispense the ice to the outside; a transferring unit that transfers the ice from a lower portion of the case to the upper portion of the case; and a crushing unit that accommodates and/or crushes the ice transferred by the transferring unit, and then discharges the ice to the dispensing port, in which the crushing unit may discharge the accommodated ice in cube shape or as crushed ice (e.g., as chips) after crushing the ice.

The crushing unit may include a housing in the transferring unit, having an inlet port at an upper side of the housing for storing the ice transferred by the transferring unit, a rotatable blade unit in the housing, configured to discharge or crush the ice; and a cover configured to open and close an outlet port formed at a lower side and/or surface of the housing so that the housing may communicate with the dispensing port.

The blade unit may include at least one rotatable blade configured to rotate in multiple directions (e.g., clockwise and counterclockwise) in the housing; and at least one stationary blade configured to press and crush the ice together with the rotatable blade when the rotatable blade rotates in one direction (e.g., one of the multiple directions).

The rotatable blade may include a first crushing portion at one side and/or end of the rotatable blade, having a saw tooth shape configured to crush the ice when the rotatable blade rotates, and the stationary blade may include a second crushing portion having a saw tooth shape at one side and/or end of the stationary blade, configured to face the first crushing portion when the rotatable blade rotates in one direction.

The rotatable blades may be radially disposed around a rotation shaft. The stationary blade may be extended from the rotation shaft, and configured to be bent or angled, so that an end portion of the stationary blade may be fixed to the housing.

The ice bin may further include a drive unit at one side of the housing, configured to transmit rotational force to the rotatable blade and the transferring unit.

The transferring unit may include a plurality of guide ribs that rotate along an outer surface of the crushing unit; ice accommodating ribs, each of which is at a side and/or end of the plurality of guide ribs; a first plate at an edge of the crushing unit, configured to connect to one end of each of the plurality of guide ribs; and a second plate on the other end of the crushing unit, configured to connect to another end of each of the plurality of guide ribs.

The plurality of guide ribs, the ice accommodating ribs, the first plate, and the second plate may be integral with each other.

The lower end surface of the case may have one side configured to be inclined downwardly (e.g., declined) toward the transferring unit.

The ice bin may further include a partition and/or wall in the case, configured to divide the case into spaces for storing and transferring the ice, with a supply port at a lower side of the partition and/or wall, configured to supply the stored ice to the transferring unit.

Embodiments of the present disclosure provides a method of crushing ice using an ice bin, including transferring ice produced in an ice maker to the ice bin; supplying the ice stored in a case of the ice bin to a transferring unit along an inclined surface at a lower end and/or surface of the case; transferring the ice from the transferring unit to a crushing unit; crushing the ice in the crushing unit; discharging the crushed ice through a dispenser.

The ice crushing step may selectively discharge the ice stored in the crushing unit as one or more whole ice cubes or as crushed ice (e.g., a plurality of chips) after crushing the ice.

The ice crushing step may simultaneously rotate a blade unit of the crushing unit and the transferring unit, such that the process of transferring and crushing the ice may be simultaneously performed.

When a rotatable blade rotates in one direction, a first crushing portion at one side and/or end of the rotatable blade may crush the ice, and when the rotatable blade rotates in another direction, the ice may be discharged in as whole ice cubes.

According to an exemplary embodiments of the present disclosure, the compact ice maker is at or in the refrigerator door, enabling efficient use of food storage space in the refrigerator, and the ice bin can be detachable from the door, so that a user may easily separate the ice bin for cleaning or other use.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
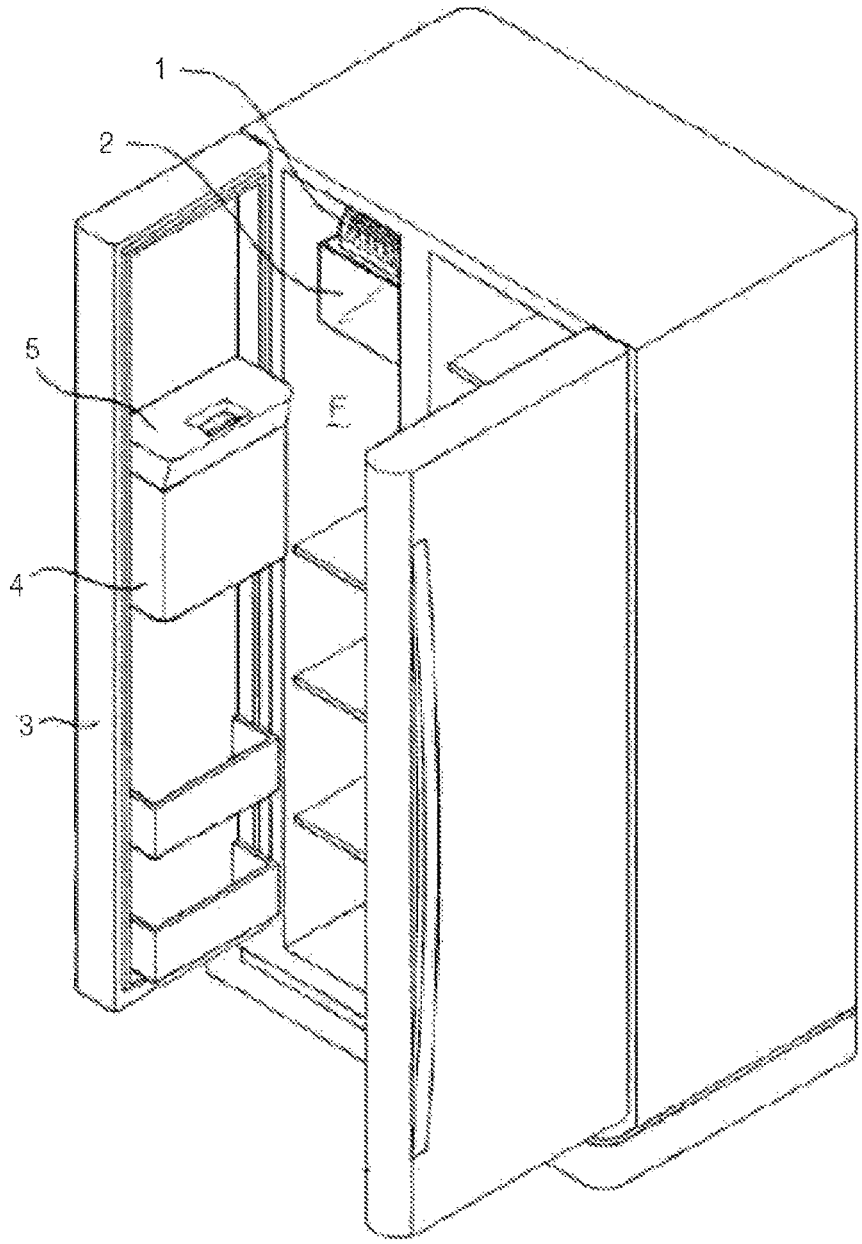
FIG. 1 is a perspective view illustrating a refrigerator in the related art.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Hereinafter, one or more exemplary embodiments according to the present disclosure will be described in detail with reference to the accompanying drawings. In this process, sizes or shapes of constituent elements illustrated in the drawings, and the like may be exaggerated for clarity and ease of description. The terms, which are specially defined in consideration of configurations and operations of the present disclosure, may vary depending on the intention or usual practice of a user or an operator. These terms should be defined based on the content throughout the present specification. The spirit of the present disclosure is not limited to the suggested exemplary embodiment(s), and those skilled in the art who understand the spirit of the present disclosure may easily carry out other exemplary embodiments within the scope of the same spirit. Of course, other exemplary embodiments also belong to the scope of the present disclosure.

Figure 2:
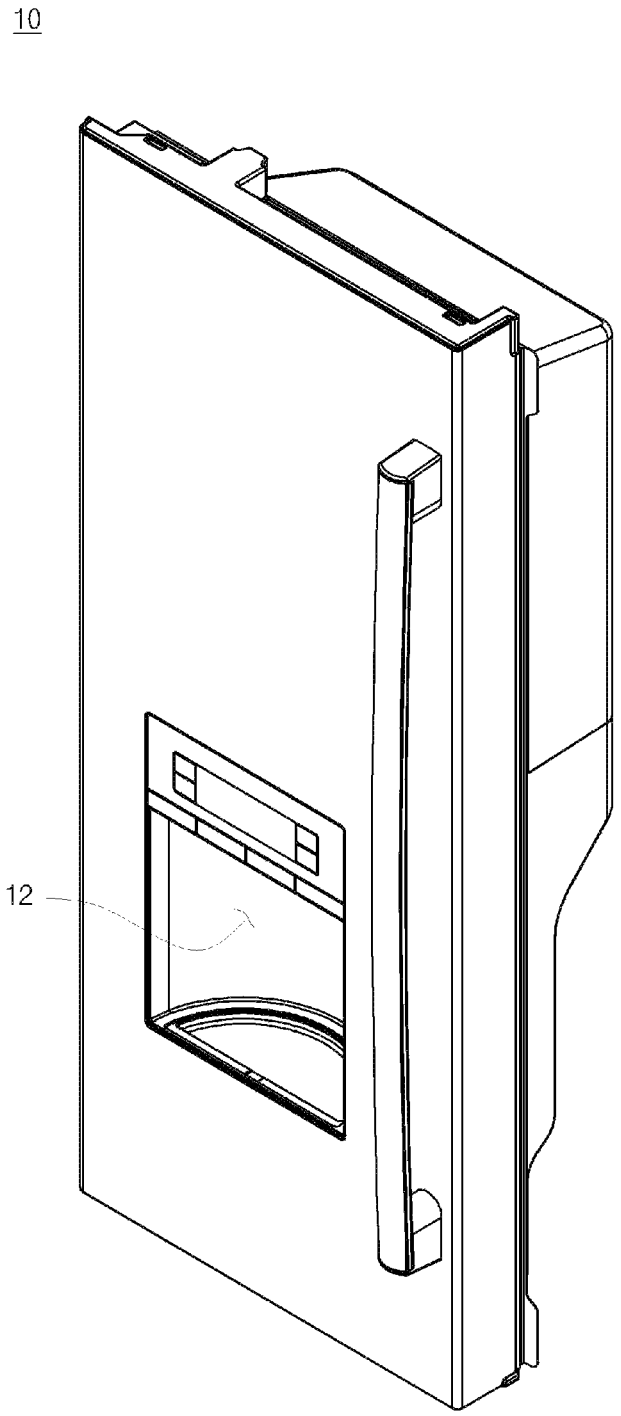
FIG. 2 is a perspective view illustrating an exemplary exterior portion of a refrigerator door according to embodiments of the present disclosure.
Figure 3:
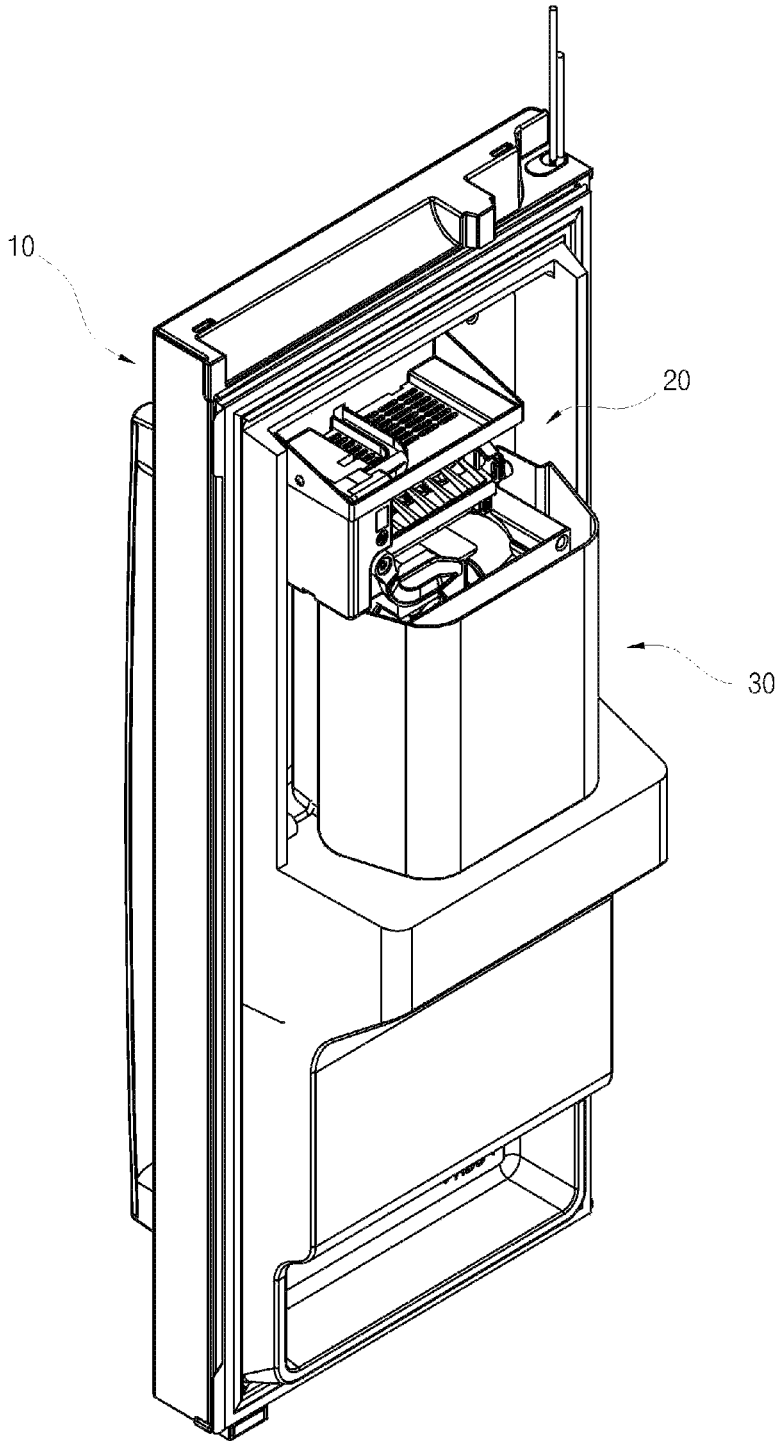
FIG. 3 is a perspective view illustrating an exemplary interior portion of the refrigerator door according to embodiments of the present disclosure.
Figure 4:
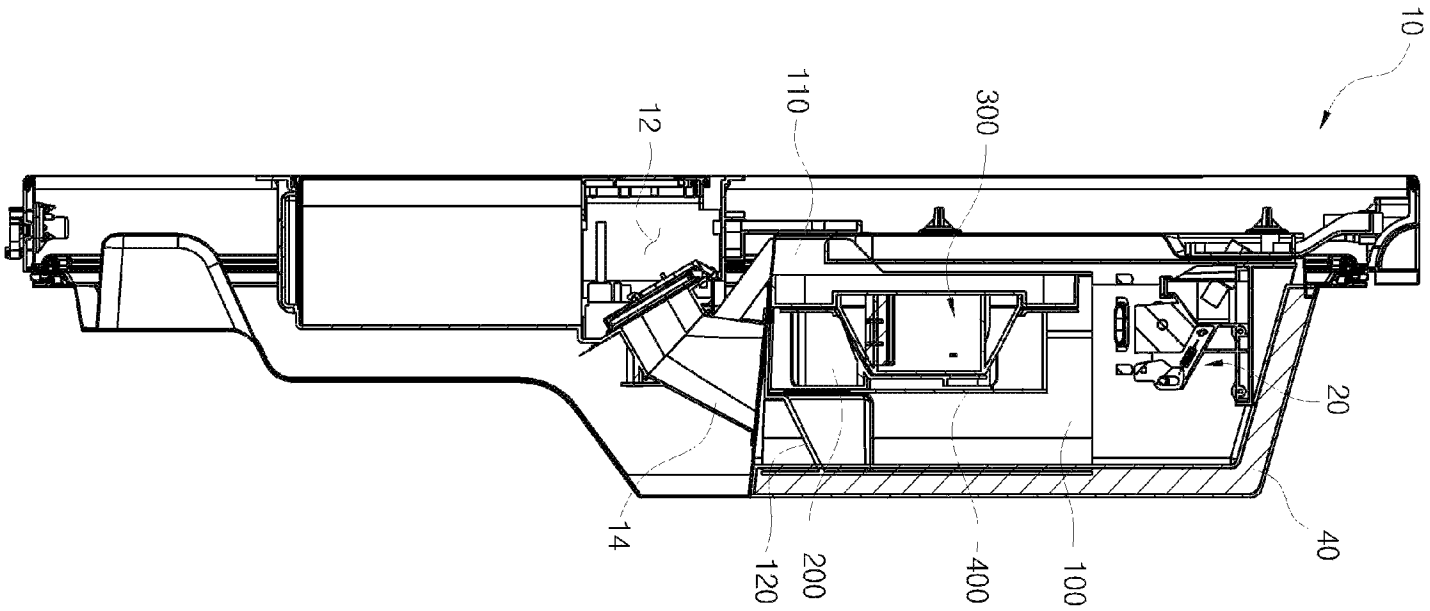
FIG. 4 is a side cross-sectional view illustrating an exemplary refrigerator door according to embodiments of the present disclosure.

FIGS. 2 and 3 are perspective views illustrating exemplary exterior and interior portions of a refrigerator door according to embodiments of the present disclosure. FIG. 4 is a side cross-sectional view illustrating an exemplary refrigerator door according to embodiments of the present disclosure. An ice maker that is provided at the refrigerator door will be described with reference to FIGS. 2 to 4.

Referring to FIG. 2, a refrigerator includes a cabinet (not illustrated) that forms a refrigerator chamber and a freezer for storing food, and doors 10 configured to open and close the refrigerator chamber and the freezer, and a dispenser 12 configured to dispense ice is at, on or in the door 10, so that a user may obtain ice outside of the refrigerator/freezer.

Referring to FIG. 3, an ice maker 20, an ice bin 30, and/or the like are inside the door 10 to supply ice to the dispenser 12.

The ice maker 20 is inside the door 10, and is configured to produce ice with water cooled using cold air in the freezer.

The ice bin 30 is at a lower side of the ice maker 20 to receive and store the ice produced by the ice maker 20.

When describing a process in which the ice is produced inside the door 10 and is then dispensed outside of the door 10 in accordance with the present disclosure with reference to FIG. 4, first, the ice maker 20 at an inner upper portion of a door 10, makes and/or produces the ice with water supplied from an outside source (e.g., a tap water line) or an internal source (e.g., a water tank in the refrigerator chamber).

The ice produced by the ice maker 20 drops into a case 100 of an ice bin 30, and then is supplied to a transferring unit 200 through a dispensing (e.g., inclined) surface 120 having a downward slope toward one side.

The ice supplied to the transferring unit 200 is transferred to a crushing unit 300, and the ice may be crushed in various forms depending on the selection of the user. The ice crushed by the crushing unit 300 is discharged to the dispenser 12 through a dispensing port 110 at a lower and/or front side or surface of the case 100, and an ice chute 14 is configured to communicate with the dispensing port 110.

According to embodiments of the present disclosure, a heat insulating member 40 may be outside the ice maker 20 and the ice bin 30 to block cold air from being discharged to the outside when the user opens and closes the door 10.

Hereinafter, a specific structure of the ice bin 30 will be described in detail with reference to FIGS. 5 to 7.

Figure 5:
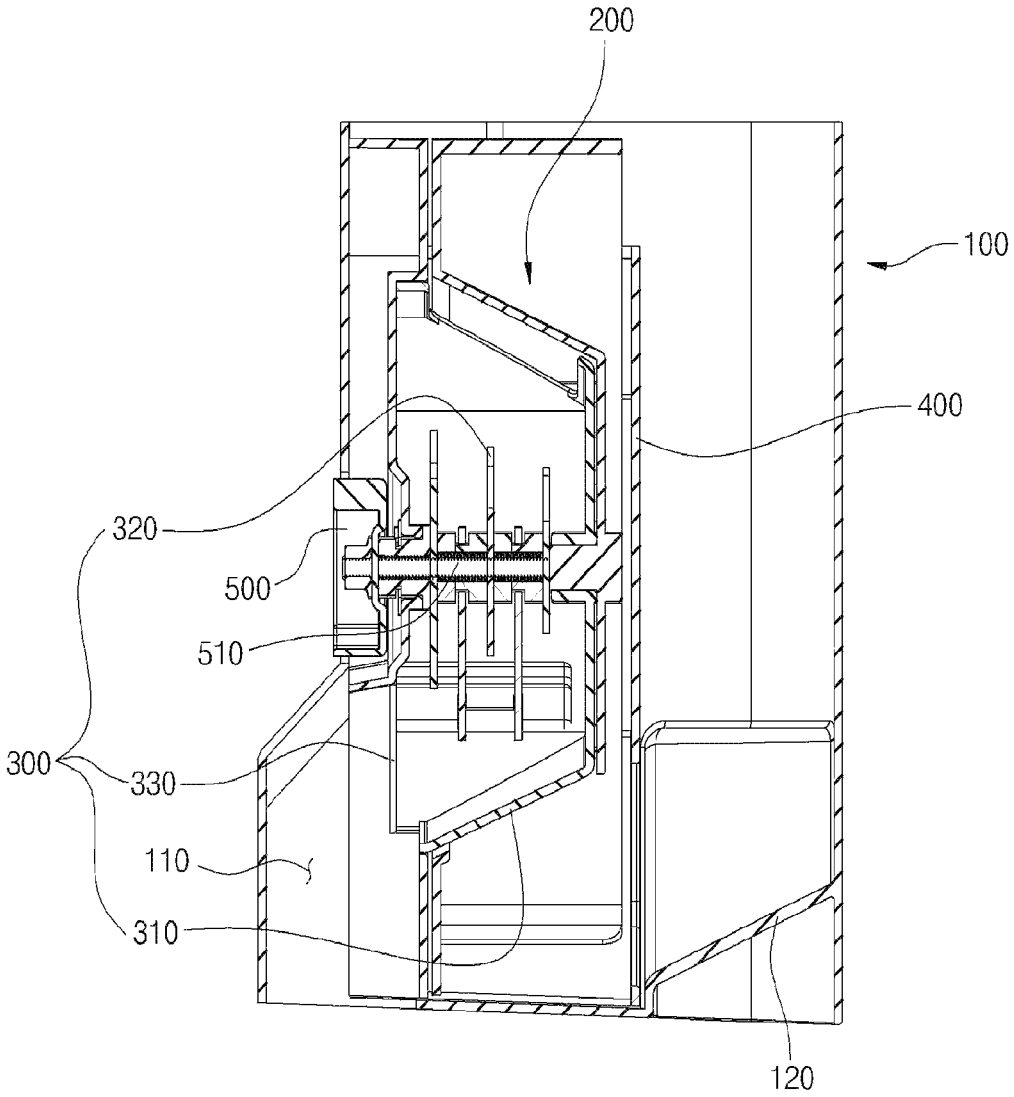
FIG. 5 is a side cross-sectional view illustrating an exemplary ice bin according to embodiments of the present disclosure.
Figure 6:
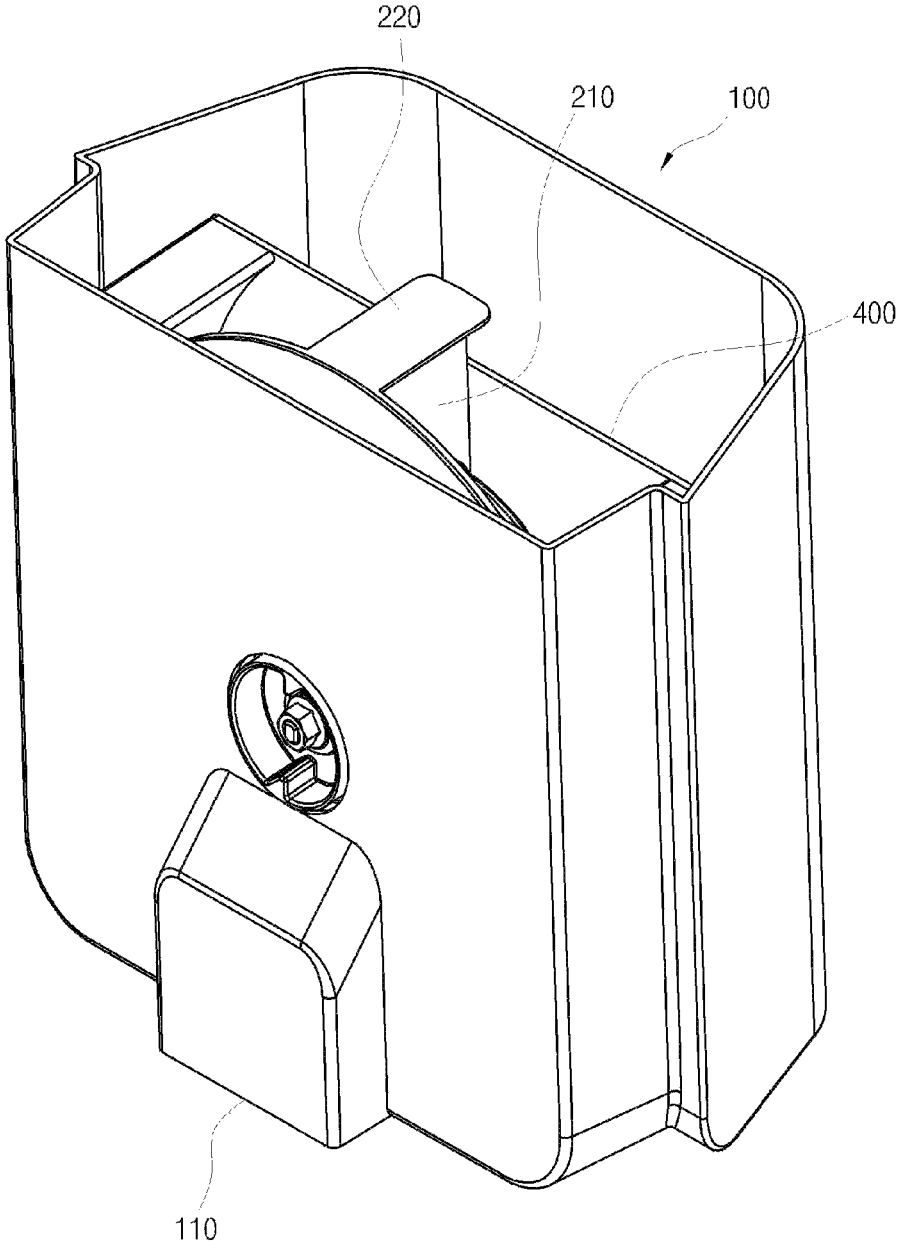
FIG. 6 is a perspective view illustrating one side of the exemplary ice bin according to embodiments of the present disclosure.
Figure 7:
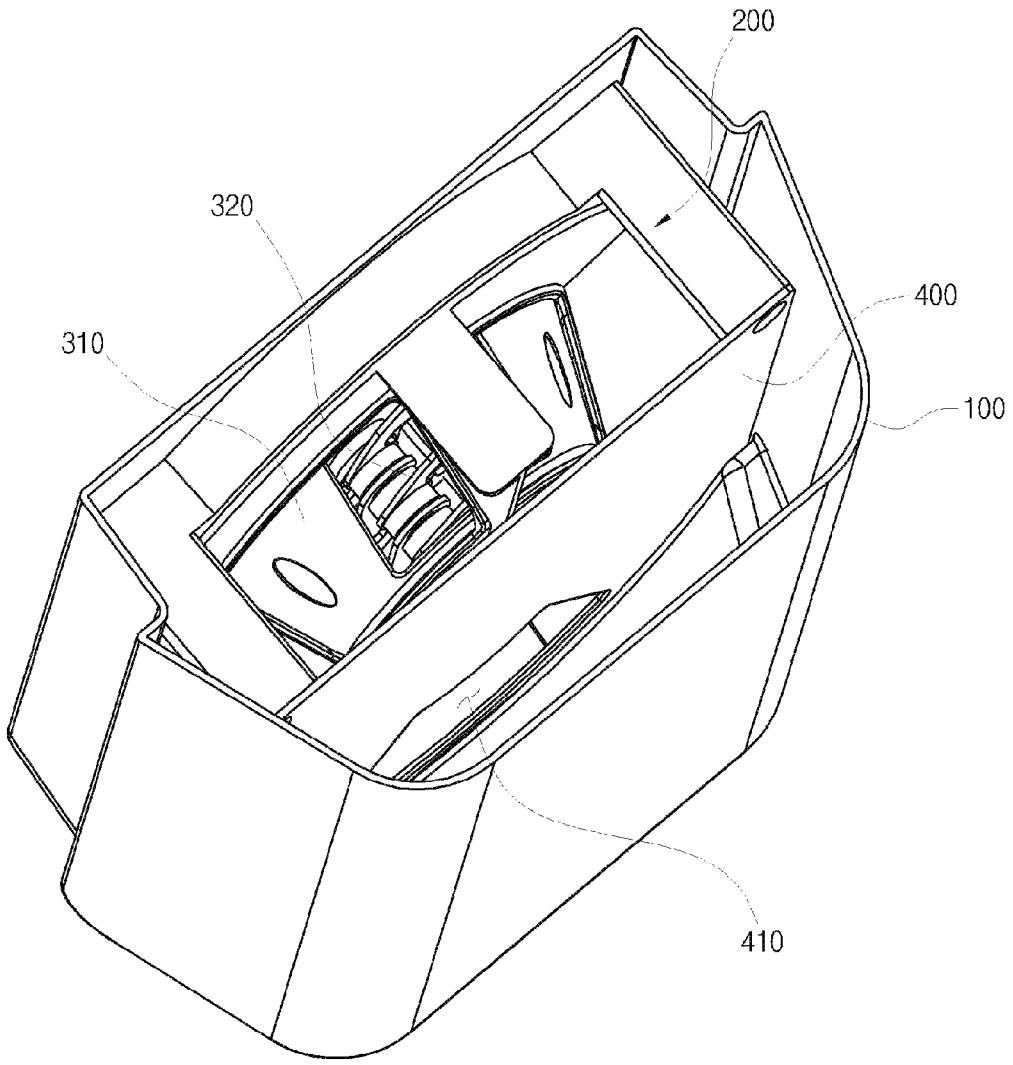
FIG. 7 is a perspective view illustrating another side of the exemplary ice bin according to embodiments of the present disclosure.

FIG. 5 is a side cross-sectional view illustrating the ice bin according to embodiments of the present disclosure, and FIGS. 6 and 7 are perspective views illustrating one side and another side of the ice bin 30 according to embodiments of the present disclosure.

Referring to FIGS. 5 to 7, the ice bin 30 includes the case 100, the transferring unit 200, the crushing unit 300, a partition and/or wall 400, and a drive unit (e.g., a motor) 500.

As described above, the case 100 stores the ice produced in the ice maker 20. An upper portion of the case 100 is open to receive the ice that drops from the ice maker 20. The dispensing port 110 is at one side (e.g., the side opposite from a gradient or declined surface of the dispensing surface) of a lower end surface of the case 100 to dispense the ice to the outside from the crushing unit 300.

The dispensing surface 120 is at another side (e.g., the opposite) of the lower end and/or surface of the case 100, and the dispensing surface 120 has a gradient or slope that declines downward toward the transferring unit 200, allowing the ice to drop from the ice maker 20, be stored in the case 100, and subsequently move toward the transferring unit 200.

The transferring unit 200 is at one side in the case 100, and is configured to transfer the ice toward a transferring space in the case 100 along the dispensing surface 120 to the upper portion of the case 100.

The crushing unit 300 accommodates and/or temporarily stores the ice that is transferred to the upper portion of the case 100 by the transferring unit 200, and discharges the ice to the dispensing port 110. The crushing unit 300 may selectively discharge the stored ice instantly as whole ice cubes or as crushed ice after crushing the ice.

The partition and/or wall 400 is in the case 100, configured to divide the case 100 for storing and transferring the ice from the transferring unit 200 to the crushing unit 300.

The partition and/or wall 400 is configured to prevent the ice stored in the case 100 from falling back to the storage space in the case 100 after the ice is transferred by the transferring unit 200.

The drive unit (e.g., motor) 500 is at one side of the crushing unit 300, configured to transmit rotational force to the transferring unit 200 and the crushing unit 300 through a drive shaft 510. The drive unit 500 may comprise a motor that is able to rotate in multiple directions (e.g., clockwise and counterclockwise).

Hereinafter, a specific structure of the crushing unit 300 will be described in detail with reference to FIGS. 8 and 9.

Figure 8:
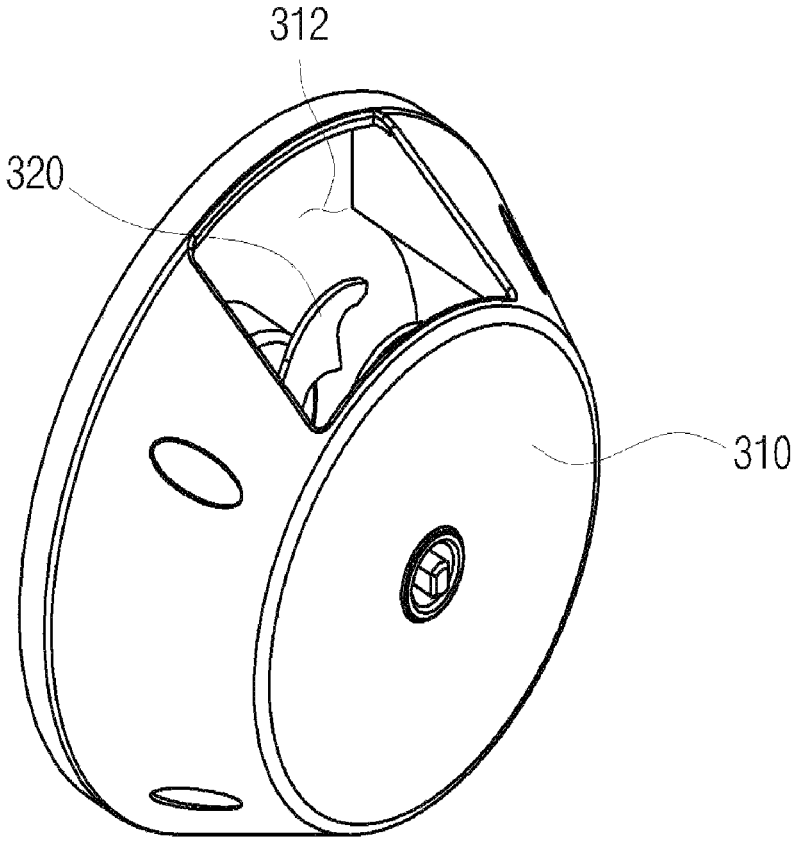
FIG. 8 is a perspective view illustrating an exemplary crushing unit of the ice bin according to embodiments of the present disclosure.
Figure 9:
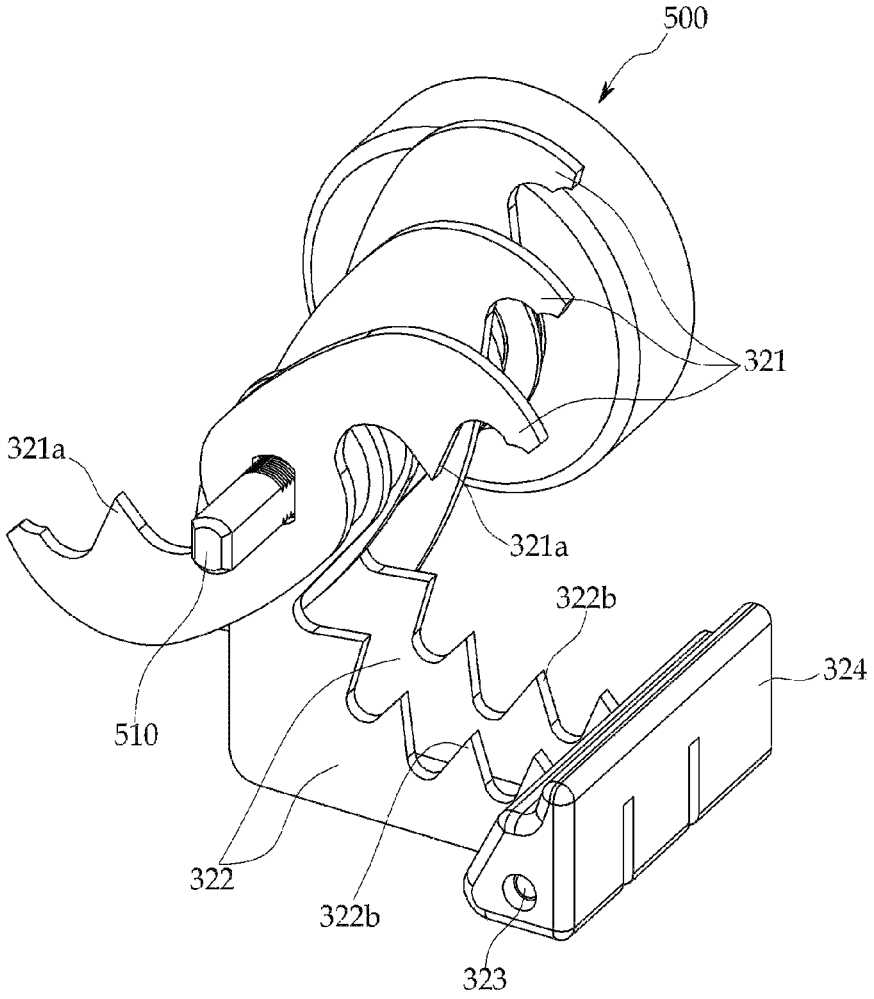
FIG. 9 is a perspective view illustrating an exemplary blade unit in the crushing unit.

FIG. 8 is a perspective view illustrating the exemplary crushing unit of the ice bin according to embodiments of the present disclosure, and FIG. 9 is a perspective view illustrating an exemplary blade unit in the crushing unit.

Referring to FIGS. 8 and 9, the crushing unit 300 includes a housing 310, a blade unit 320, and a cover 330 (as illustrated in FIG. 5).

Figure 11:
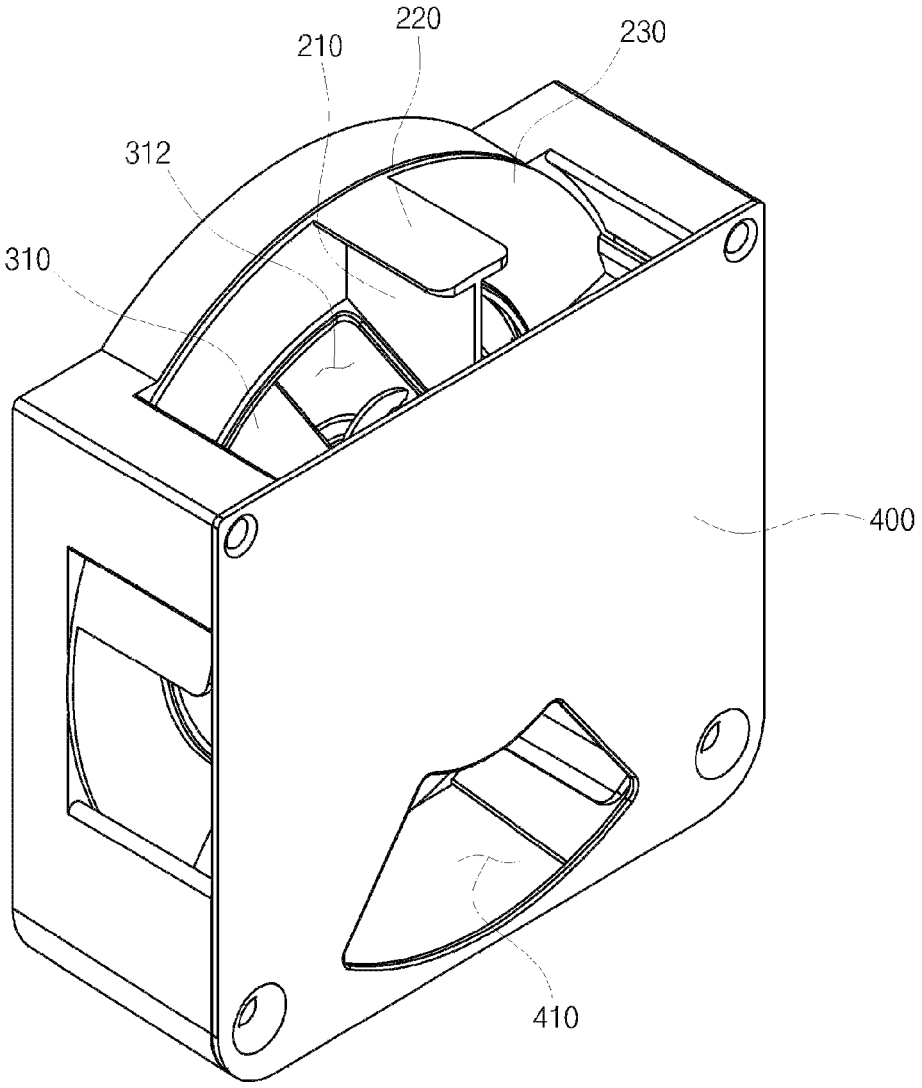
FIG. 11 is a perspective view illustrating an exemplary partition and/or wall being coupled to the crushing unit and the transferring unit.

The housing 310 is in the transferring unit 200, and an inlet port 312 is at an upper side of the housing 310, so that the ice that is transferred by guide ribs 210 (as illustrated in FIG. 11) of the transferring unit 200 enters the housing 310.

As illustrated in FIG. 8, the housing 310 may have a conical and/or columnar shape, having one end, side, or surface with a greater diameter than another end, side, or surface, rather than having a typical cylindrical shape.

When the housing 310 has in a conical and/or columnar shape, a side surface of the housing 310 declines downward toward the dispensing port 110 (as illustrates FIG. 5), so that the crushed ice may move to the dispensing port 110.

The rotatable blade unit 320 is in the housing 310 and configured to discharge the ice that enters through the inlet port 312. The rotatable blade unit 320 is supplied with rotational force from the drive unit 500 at one side of the housing 310.

The rotatable blade unit 320 and the transferring unit 200 are rotated together by the drive shaft 510, such that the processes of transferring and crushing the ice may be simultaneously performed.

As described above, since the drive unit 500 may comprise a motor configured to driven in multiple directions. When the guide rib 210 of the transferring unit 200 rotates in one direction, the rotatable blade unit 320 rotates in the same direction, and when the guide rib 210 rotates in the other direction, the blade unit 320 also rotates in the other direction.

The rotatable blade unit 320 includes a rotatable blade 321, and a stationary blade 322.

The rotatable blade 321 is configured to be rotated in both clockwise and counterclockwise directions in the housing 310. According to embodiments of the present disclosure, at least three rotatable blades 321 are radially disposed around the drive shaft 510.

The number of rotatable blades 321 may vary depending on the amount of ice stored in the housing 310, and the content of the present disclosure is not limited by the number of rotatable blades 321.

A first crushing portion 321*a* has a saw tooth shape, and is configured to form at one side and/or end of the rotatable blade 321 to crush the ice when the rotatable blade 321 rotates in one direction.

When the rotatable blade 321 rotates in another direction, the ice stored in the housing 310, is discharged to an outlet port (e.g., another side and/or end of the rotatable blade 321) away from a saw tooth shape of the rotatable blade 321, so that the ice is not crushed and may be discharged as whole ice cubes.

At least one stationary blade 322 is configured to press and/or crush the ice together with the rotatable blade 321 being rotated in one direction. The stationary blade 322 extends from the drive shaft 510 by a predetermined length, and is configured to bend toward an inner surface of the housing 310. An end portion of the stationary blade 322 is fixed to the inner surface of the housing 310.

When specifically describing a structure of the stationary blade 322, a shaft cover 324 is at an end portion or side of the stationary blade 322, and the shaft cover 324 is attached to the inner surface of the housing 310.

A shaft 323 is in the shaft cover 324, and the shaft 323 is coupled to an end portion of the stationary blade 322, such that the end portion of the stationary blade 322 is fixed.

Therefore, even though the drive shaft 510 rotates and the rotatable blade 321 is rotated with the rotation of the drive shaft 510, the stationary blade 322 may be maintained in a predetermined position in the housing 310.

A second crushing portion 322*a* has a saw tooth shape, and is at one side and/or end of the stationary blade 322, so as to face the first crushing portion 321*a* when the rotatable blade 321 rotates in one direction.

When the process of crushing the ice is performed in the housing 310, the rotatable blade 321 rotates in one direction, and the ice is pressed and crushed between the first crushing portion 321*a* and the second crushing portion 322*a*.

In order to immediately discharge the ice without crushing the ice (e.g., discharge the ice as whole ice cubes), the rotatable blade 321 rotates in another direction away from the saw tooth side and/or end of the first and second crushing portions.

When the rotatable blade 321 rotates in one direction, the first crushing portion 321*a* and the second crushing portion 322*a* repeatedly face each other, and thus, the ice placed into the housing 310, is pressed and crushed between the first crushing portion 321*a* and the second crushing portion 322*a*.

In order to discharge the ice without crushing (e.g., as whole ice cubes), the rotatable blade 321 rotates in the other direction (e.g., counterclockwise).

The cover 330 opens and closes the outlet port which is at a lower side and/or surface of the housing 310, so that the interior of the housing 310 communicates with the dispensing port 110.

According to embodiments of the present disclosure, the cover 330 is configured to close the outlet port while transferring the ice or crushing the ice. The cover 330 is configured to open the outlet port after the processes of transferring and/or crushing the ice, so that the crushed ice may be discharge to the dispensing port 110.

Hereinafter, a specific structure of the transferring unit 200 that transfers the ice to the crushing unit 300, will be described in detail with reference to FIG. 10.

Figure 10:
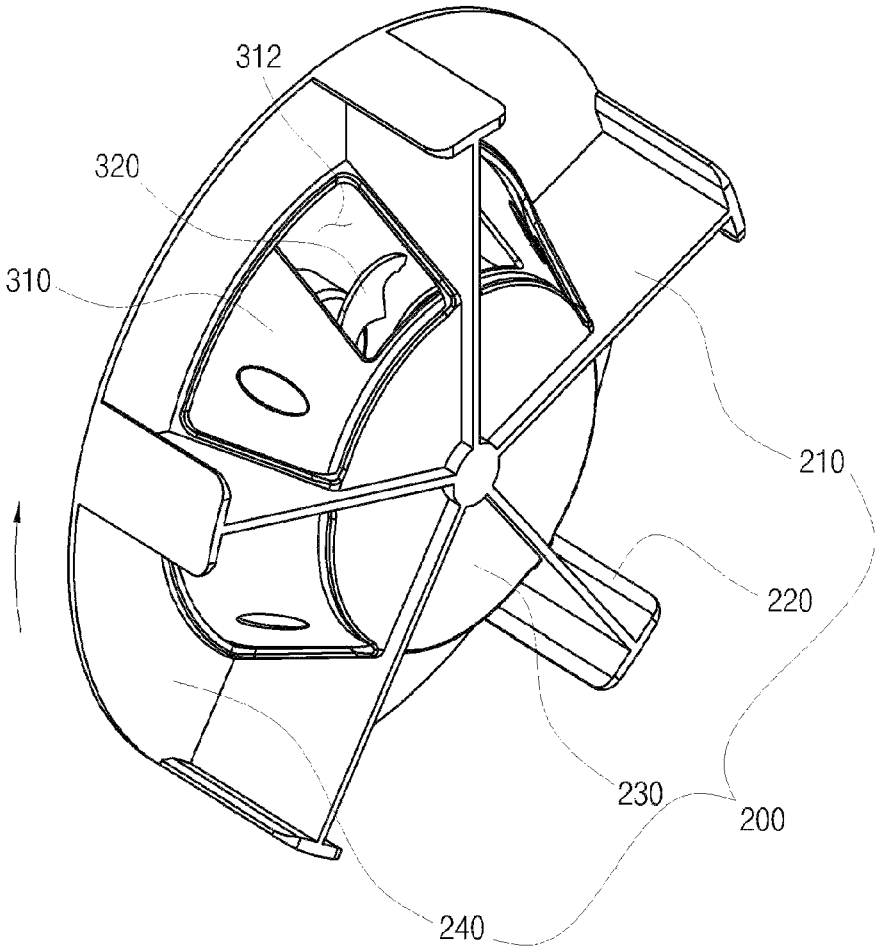
FIG. 10 is a perspective view illustrating an exemplary transferring unit being coupled to the crushing unit.

FIG. 10 is a perspective view illustrating the transferring unit being coupled to the crushing unit. Referring to FIG. 10, the transferring unit 200 is outside the crushing unit 300, may rotate, and includes a plurality of guide ribs 210, ice accommodating ribs 220, a first plate 230, and a second plate 240.

The plurality of guide ribs 210 rotate along an outer surface of the housing 310 of the crushing unit 300 to move the ice to an upper portion of the case 100, and place the ice into the inlet port 312 of the housing 310.

According to embodiments of the present disclosure, the plurality of guide ribs 210 may be rotatable in multiple directions (e.g., clockwise and counterclockwise) depending on a usage of the ice bin 30.

Since the rotatable blade 321 rotates in another direction to discharge the ice with crushing process, the guide ribs 210 also rotate in the same direction with the rotation of the rotatable blade 321.

In contrast, when the rotatable blade 321 rotates in one direction to discharge crushed ice, the guide ribs 210 also rotate in the same direction with the rotation of the rotatable blade 321 to put the ice into the housing 310.

Hence, as described above, the drive unit 500 is on one surface of the case 100, and may comprise a motor that is capable of rotating in multiple directions (e.g., clockwise and counterclockwise).

According to embodiments of the present disclosure, five guide ribs 210 are radially disposed around a rotation shaft. The number of guide ribs 210 may change or vary depending on the capacity of the storage space and/or the transferring space of the ice bin 30, and the present disclosure is not limited by the number of guide ribs 210.

Each of the ice accommodating ribs 220 is on an outer end or periphery of a corresponding one of the plurality of guide ribs 210, configured to prevent the ice, which is transferred by the guide ribs 210, from deviating away from the path (e.g., the path where the ice is transferred from the transferring to the crushing unit).

Since the plurality of guide ribs 210 may be rotated in multiple or opposite directions depending on the usage, the ice accommodating rib 220 may extend from the outer end of the guide rib 210 toward opposed sides by a predetermined length or distance.

The first plate 230 may have a circular or ring shape on one end, side and/or edge of the housing 310 of the crushing unit 300, and be connected to one end and/or edge of each of the plurality of guide ribs 210.

The second plate 240 may have an annular, circular or ring shape on another end or side of the housing 310 of the crushing unit 300, and connected to another end or side (but optionally the same edge) of each of the plurality of guide ribs 210.

As such, the first plate 230 and the second plate 240 are connected to the plurality of guide ribs 210, and are configured to support the plurality of guide ribs 210.

According to embodiments of the present disclosure, all of the plurality of guide ribs 210, the ice accommodating ribs 220, the first plate 230, and the second plate 240 may be integral with each other.

FIG. 11 is a perspective view illustrating the partition and/or wall is coupled to the crushing unit and the transferring unit. A structure of the partition and/or wall 400 will be described in detail with reference to FIG. 11.

As described above, the partition and/or wall 400 is configured to prevent the ice transferred by the transferring unit 200 from falling back to the storage space in the case 100, and to divide the case 100 for storing and for transferring the ice.

Specifically, first, the ice is made in the ice maker 20, drop, and is placed in the ice bin 30 in the storage space of the case 100.

The ice stored in the case 100 is moved along the dispensing surface 120 to the transferring unit 200 through a supply port 410 that is formed at a lower side of the partition and/or wall 400.

The ice that is moved to the transferring unit 200, may be placed into the crushing unit 300 from the interior of the transferring space that is formed by the partition and/or wall 400.

Figure 12:
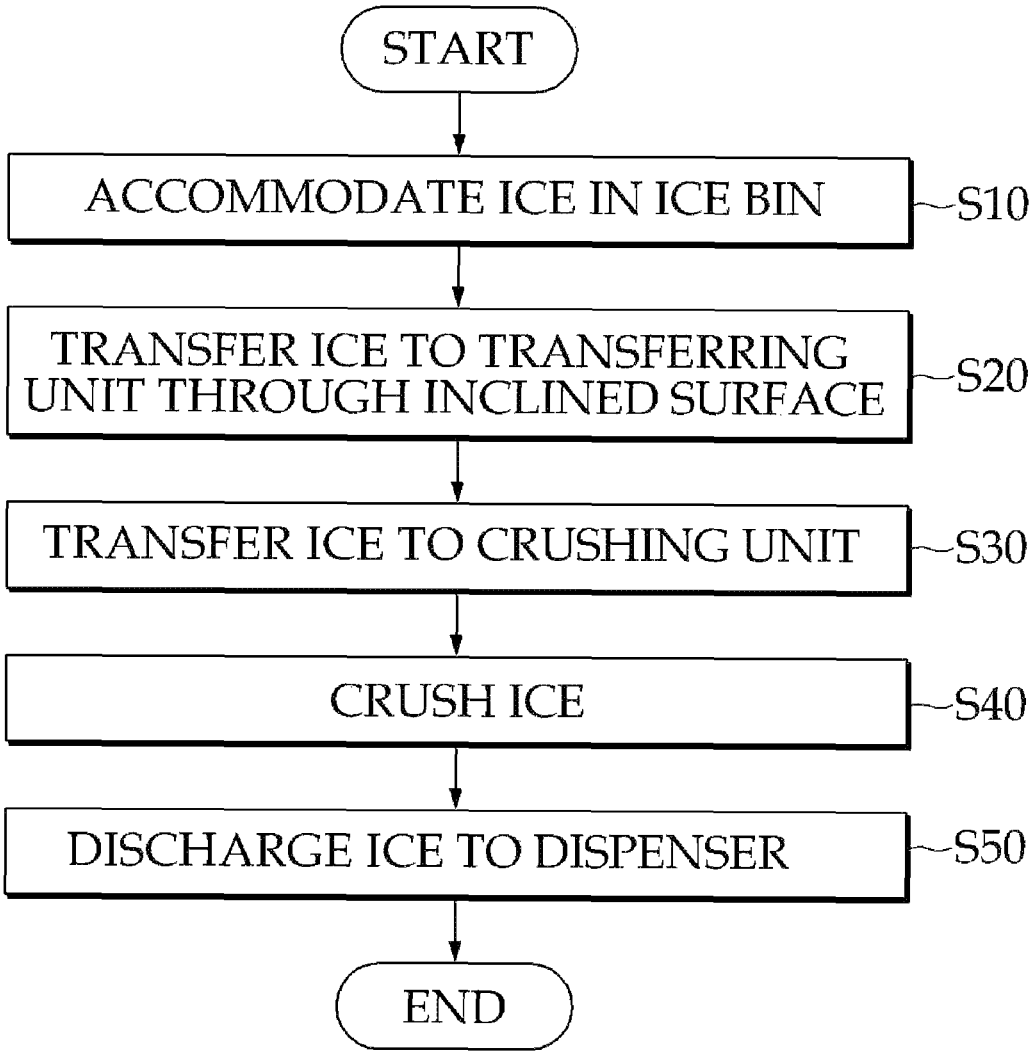
FIG. 12 is a flowchart illustrating an exemplary method of crushing ice using the ice bin according to embodiments of the present disclosure.

FIG. 12 is a flowchart illustrating an exemplary method of crushing ice using the ice bin according to embodiments of the present disclosure. The method of crushing ice will be described in detail with reference to FIG. 12.

First, the ice maker 20 is inside the door 10 and configured to produce ice with water cooled by cold air in the freezer, and the produced ice drops downward, and is accommodated and/o/r stored in the ice bin 30 (illustrated as step S10).

At step S10, the case 100 of the ice bin 30 has an upper portion accommodating or storing the ice produced in the ice maker 20.

When the ice is accommodated and/or stored in the case 100, the ice is supplied to the transferring unit 200 along the dispensing surface 120 at the lower end and/or surface of the case 100 (illustrated as step S20).

At step S20, the lower end surface of the case 100 has a gradient or slope that declines toward the transferring unit 200 along the dispensing surface 120, such that the ice stored or accommodated in the case 100 moves toward the transferring unit 200.

When the ice is supplied to the transferring unit 200, the ice can be transferred to the crushing unit 300 (illustrated as step S30).

At step S30, the ice is supported and/or moved by the plurality of guide ribs 210 configured to rotate along the outer surface of the crushing unit 300, and enters the inlet port 312 at the upper side of the crushing unit 300. The plurality of guide ribs 210 may rotate in multiple and/or opposite directions (e.g., clockwise and counterclockwise).

Furthermore, the ice accommodating ribs 220 are at the ends of guide ribs 210.

When the ice is transferred to the crushing unit 300 at step S30, the ice is crushed (illustrated as step S40) in the housing 310 of the crushing unit 300.

At step S40, the crushing unit 300 may selectively discharges the ice in the crushing unit 300 as whole ice cubes or as crushed ice after crushing the ice.

Specifically, when the rotatable blade 321 of the blade unit 320 rotates in one direction, the first crushing portion 321*a* at one side and/or end of the rotatable blade 321, crushes the ice, and when the rotatable blade 321 rotates in the opposite direction, the ice is discharged as whole ice cubes without the crushing process.

At step S40, the blade unit 320 and the transferring unit 200 may be simultaneously rotated, such that the process of transferring and crushing the ice may be simultaneously performed.

When the ice is crushed at step S40, the crushed ice is moved through the ice chute 14 that is configured to communicate with the dispensing port 110 and is discharged to the outside through the dispenser 12 (illustrated as step S50).

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. An ice bin comprising:

a case having a first portion configured to store and/or accommodate ice produced by an ice maker, and a dispensing port at one side of an end and/or surface of the case, configured to dispense the ice; and a crushing unit configured to crush the ice transferred by a transferring unit and discharge the ice to the dispensing port, wherein the crushing unit selectively discharges the ice as whole ice cubes or as crushed ice, and wherein the crushing unit comprises:

a housing in the transferring unit, having an inlet port at first side of the housing to store ice transferred from the transferring unit;

a rotatable blade unit in the housing configured to discharge or crush the ice in the housing; and a cover configured to open and close an outlet port at a second side and/or surface of the housing, wherein the housing is configured to communicate with the dispensing port.

2. The ice bin of claim 1, wherein the blade unit comprises:

at least one rotatable blade configured to rotate in multiple directions; and at least one stationary blade configured to press and/or crush the ice with the rotatable blade when the rotatable blade rotates in one direction.

3. The ice bin of claim 2, wherein the rotatable blades are radially disposed around a rotation shaft.

4. The ice bin of claim 2, wherein the stationary blade extends from the rotation shaft of the rotatable blade, and is curved or bent, having an end portion fixed to the housing.

5. The ice bin of claim 2, further comprising:

a drive unit at one side of the housing, configured to transmit rotational force to the rotatable blade and the transferring unit.

6. The ice bin of claim 2, wherein the rotatable blade comprises a first crushing portion at one side and/or end of the rotatable blade.

7. The ice bin of claim 6, wherein the first crushing portion has a saw tooth shape, configured to crush the ice when the rotatable blade rotates.

8. The ice bin of claim 6, wherein the stationary blade comprises a second crushing portion at one side and/or end of the stationary blade, configured to face the first crushing portion of the rotatable blade.

9. The ice bin of claim 8, wherein the stationary blade has a saw tooth shape.

10. The ice bin of claim 1, wherein the transferring unit comprises:

a plurality of guide ribs configured to rotate along an outer surface of the crushing unit;

accommodating ribs at a side or end of each of the plurality of guide ribs;

a first plate at an end or side of the crushing unit, connected to one end, edge, or surface of each of the plurality of guide ribs; and a second plate on or at another end or side of the crushing unit, connected to another end or surface of each of the plurality of guide ribs.

11. The ice bin of claim 10, wherein the plurality of guide ribs, the ice accommodating ribs, the first plate, and the second plate are integral with each other.

12. The ice bin of claim 1, wherein the end or surface of the case has a slope downward toward the transferring unit.

13. The ice bin of claim 1, further comprising:

a partition and/or wall in the case, configured to divide the case for storing and transferring the ice.

14. The ice bin of claim 13, wherein the partition and/or wall has a supply port at a side of the partition and/or wall, configured to supply the ice stored in the case to the transferring unit.

* * * * *